US011605906B2

(12) United States Patent
Robicheau et al.

(10) Patent No.: US 11,605,906 B2
(45) **Date of Patent: *Mar. 14, 2023**

(54) COMPRESSION CONNECTORS WITH INSULATING COVER

(71) Applicant: Hubbell Incorporated, Shelton, CT (US)

(72) Inventors: Richard E. Robicheau, Litchfield, NH (US); Glen Harrison Ruggiero, Manchester, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/745,179

(22) Filed: Jan. 16, 2020

(65) Prior Publication Data

US 2020/0235498 A1 Jul. 23, 2020

Related U.S. Application Data

(60) Provisional application No. 62/794,296, filed on Jan. 18, 2019.

(51) Int. Cl.

| | |
|---|---|
| ***H01R 4/18*** | (2006.01) |
| ***H01R 4/2406*** | (2018.01) |
| ***H01R 4/70*** | (2006.01) |

(52) U.S. Cl.

CPC ..... *H01R 4/186* (2013.01); *H01R 4/184* (2013.01); *H01R 4/2406* (2018.01); *H01R 4/70* (2013.01)

(58) Field of Classification Search

CPC ..... H01R 4/184; H01R 4/186; H01R 4/20; H01R 4/24; H01R 4/2404; H01R 9/0503

See application file for complete search history.

(56) References Cited

U.S. PATENT DOCUMENTS

| | | | | |
|---|---|---|---|---|
| 2,359,256 A | | 9/1944 | Spence | |
| 2,597,037 A | | 5/1952 | Runde | |
| 2,779,842 A | * | 1/1957 | Walker | H01R 4/2495 337/415 |
| 2,938,069 A | | 5/1960 | Toedtman et al. | |
| 2,956,108 A | | 10/1960 | Brenner | |
| 3,113,822 A | | 12/1963 | Sofglaten | |
| 3,191,139 A | | 6/1965 | Schiffmann | |
| 3,194,877 A | | 7/1965 | Collier | |
| 3,322,888 A | | 5/1967 | Zemels | |
| 3,354,517 A | | 11/1967 | Levinsky | |
| 3,425,028 A | * | 1/1969 | Adolph | H01R 4/42 29/874 |

(Continued)

FOREIGN PATENT DOCUMENTS

FR 2484716 * 12/1981

OTHER PUBLICATIONS

YH292C Data Sheet Burndy Electrical (FCI USA Inc.) Dec. 28, 1990, Rev. 9.

(Continued)

*Primary Examiner* — Chau N Nguyen

(74) *Attorney, Agent, or Firm* — Wissing Miller LLP

(57) ABSTRACT

The present disclosure provides embodiments of insulated compression-type electrical connectors used to connect one or more branch wires or conductors to one or more run wires or conductors.

6 Claims, 11 Drawing Sheets

(56) References Cited

U.S. PATENT DOCUMENTS

| | | | | |
|---|---|---|---|---|
| 3,579,173 | A * | 5/1971 | Greener | H01R 11/20 439/420 |
| 3,668,613 | A | 6/1972 | Klosin | |
| 3,710,303 | A | 1/1973 | Gallager, Jr. | |
| 3,746,777 | A | 7/1973 | Peek | |
| 3,781,459 | A | 12/1973 | Peek | |
| 3,826,861 | A * | 7/1974 | Karl | H01R 4/2495 174/84 C |
| 4,050,761 | A | 9/1977 | De Frane | |
| 4,080,034 | A | 3/1978 | Werner | |
| 4,293,176 | A | 10/1981 | Lindof | |
| 4,350,843 | A | 9/1982 | Campbell et al. | |
| 4,427,253 | A | 1/1984 | Smith et al. | |
| 4,722,579 | A * | 2/1988 | Cummings | H01R 4/2404 439/391 |
| 5,036,164 | A | 7/1991 | Schrader et al. | |
| 5,103,068 | A | 4/1992 | Schrader | |
| 5,162,615 | A | 11/1992 | Schrader et al. | |
| 5,200,576 | A | 4/1993 | Schrader et al. | |
| 5,396,033 | A | 3/1995 | Piriz et al. | |
| 5,552,564 | A | 9/1996 | Schrader et al. | |
| 5,635,676 | A | 6/1997 | Piriz | |
| 5,898,131 | A | 4/1999 | Chadbourne et al. | |
| 6,099,344 | A | 8/2000 | Chadbourne | |
| 6,261,137 | B1 | 7/2001 | Wilcox | |
| 6,525,270 | B1 | 2/2003 | Connor et al. | |
| 6,538,204 | B2 | 3/2003 | Connor | |
| 7,511,224 | B1 | 3/2009 | Kossak | |
| 7,766,704 | B2 | 8/2010 | Robinson et al. | |
| 9,082,560 | B2 * | 7/2015 | Helms | H01H 1/06 |
| 9,368,296 | B2 | 6/2016 | Holland et al. | |
| 9,577,351 | B2 | 2/2017 | Martin | |
| 10,547,124 | B2 | 1/2020 | Robicheau | |
| 2002/0098745 | A1 * | 7/2002 | Triantopoulos | H01R 4/186 439/877 |
| 2003/0010524 | A1 | 1/2003 | Connor | |
| 2008/0113553 | A1 | 5/2008 | Legrady et al. | |
| 2014/0152949 | A1 | 9/2014 | Evan | |
| 2015/0162670 | A1 * | 6/2015 | Galla | H01R 43/01 29/872 |
| 2015/0229037 | A1 | 8/2015 | Uchida | |
| 2019/0058265 | A1 | 2/2019 | Robicheau et al. | |

OTHER PUBLICATIONS

YH298C Data Sheet Copper H-Frames Jul. 11, 2002.

International Search Report and Written Opinion mailed in corresponding International Application PCT/US20/13951 dated Jan. 16, 2020 (9 pages).

International Preliminary Report on Patentability mailed in corresponding application on PCT/US20/13951 dated Jul. 29, 2021 (8 pages.).

* cited by examiner

Fig. 7
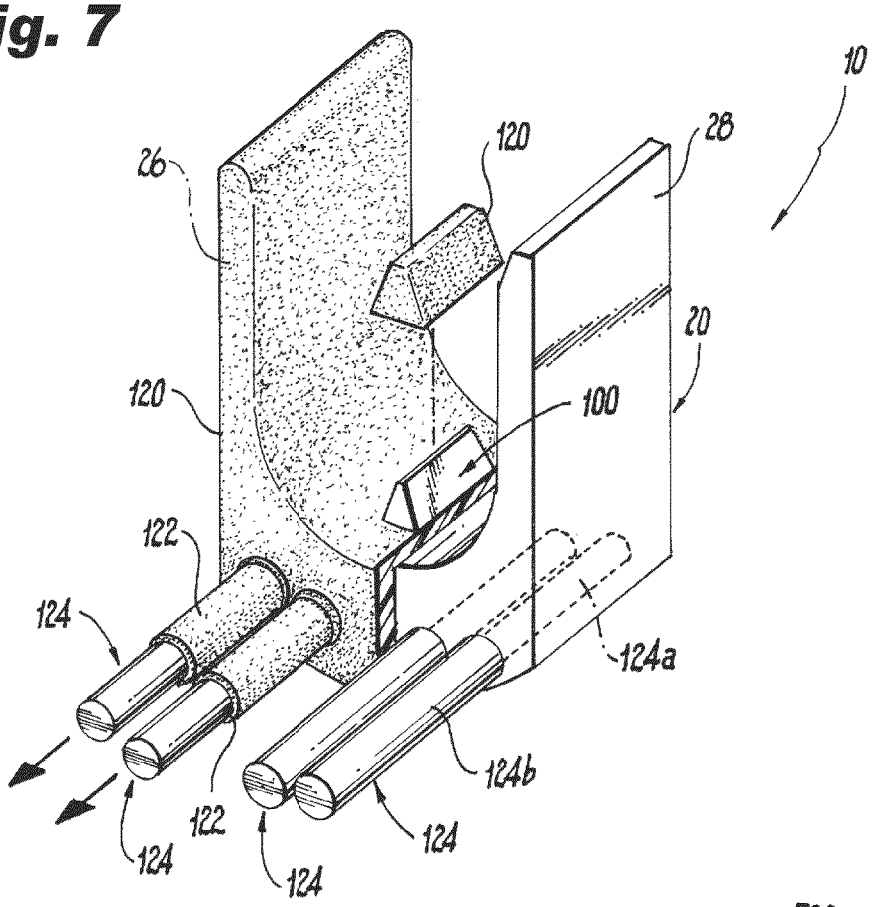
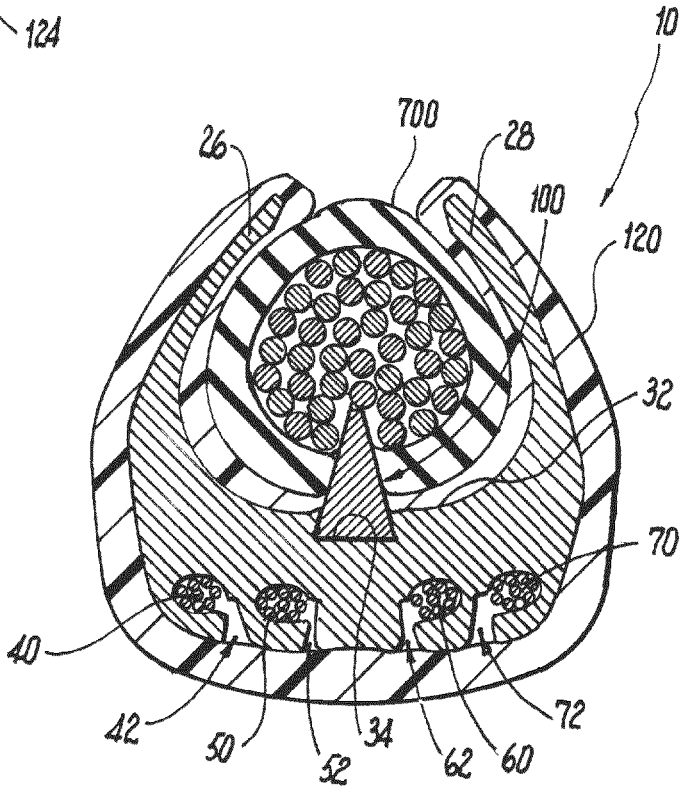
Fig. 8

Fig. 9
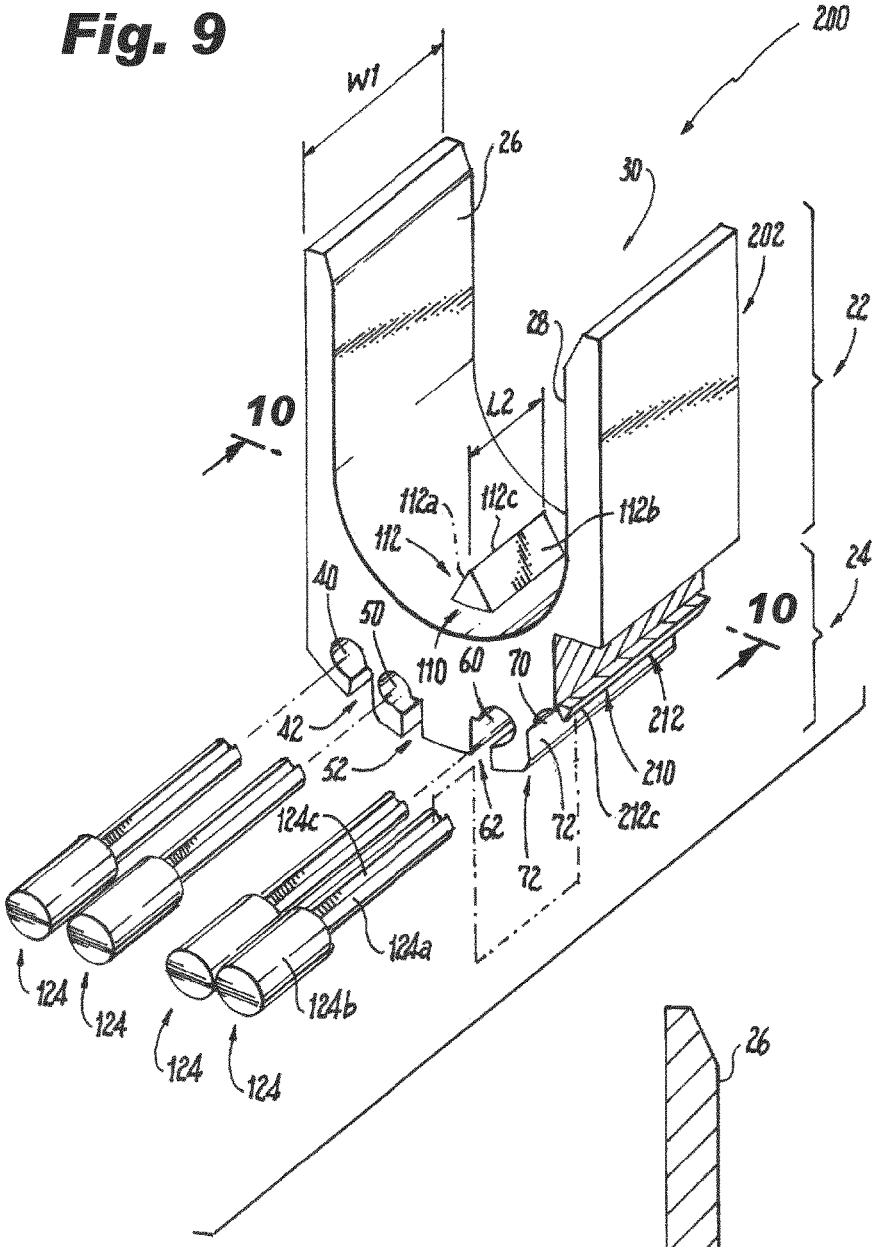
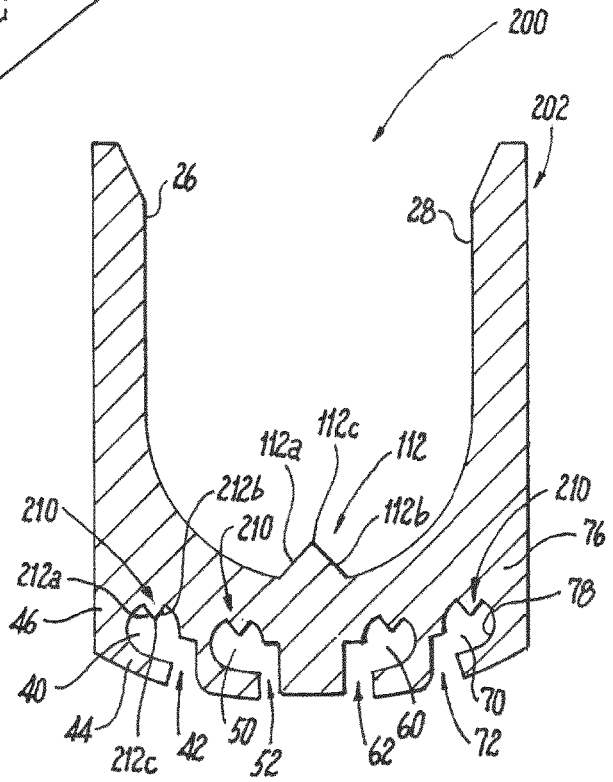
Fig. 10

COMPRESSION CONNECTORS WITH INSULATING COVER

CROSS REFERENCE TO RELATED APPLICATIONS

The present disclosure is based on and claims benefit from U.S. Provisional Patent Application Ser. No. 62/794,296 filed on Jan. 18, 2019 entitled "Compression Connectors with Insulating Cover" the contents of which are incorporated herein in their entirety by reference.

BACKGROUND

Field

The present disclosure relates generally to insulated electrical compression connectors for electrically and compressively connecting two or more solid or stranded wires or conductors together. More specifically, the present disclosure relates to compression-type electrical connectors for electrically and compressively connecting two or more solid or stranded wires or conductors together.

Description of the Related Art

Tap connectors have been used to establish an electrical connection between a continuous main power conductor to a branch conductor. Similarly, tap connectors have been used to establish an electrical connection between a distribution power conductor (also referred to as a run) and one or more main power conductors. Compression type tap connectors are typically adapted to receive a branch or tap conductor, to engage a continuous run conductor, and to be compressed by means of a crimping tool to achieve the desired connection. Such connectors are not coated with an insulating cover.

SUMMARY

The present disclosure provides embodiments of compression-type electrical connectors used to connect one or more branch wires or conductors to one or more run wires or conductors. In an exemplary embodiment, the compression connector includes a connector body and an insulating coating surrounding the connector body. The connector body is preferably made of compressible material adapted to be inserted into a crimping tool. The connector body includes a run conductor portion and a branch conductor portion. The run conductor portion includes a pair of side walls joined by a bottom wall, a run conductor opening between the pair of side walls and the bottom wall, and at least one insulation piercing member extending from at least one of the pair of side walls and the bottom wall into the run conductor opening. The branch conductor portion includes at least one branch conductor opening having a lead-in with a rib adjacent the lead-in, and a hinge portion between the branch conductor opening and the connector body. The insulation coating surrounds the connector body such that an interior wall of the at least one branch conductor opening and the at least one insulation piercing member are not covered by the insulation coating.

BRIEF DESCRIPTION OF THE DRAWINGS

The figures depict embodiments for purposes of illustration only. One skilled in the art will readily recognize from the following description that alternative embodiments of the structures illustrated herein may be employed without departing from the principles described herein, wherein:

FIG. 7 is a perspective view of the compression connector of FIG. 6 after the insulating coating is applied, and illustrating a portion of the insulating coating removed;

FIG. 8 is a cross-sectional view of the compression connector of FIG. 5 taken from line 8-8 after the compression connector has been subjected to a crimping operation to electrically and compressively connect the run conductors to the branch conductors;

FIG. 9 is a perspective view of another exemplary embodiment of a compression connector according to the present disclosure prior to receiving the insulating coating, illustrating branch conductor openings for receiving branch conductors each having an insulation piercing member integrally formed into an interior wall of the branch conductor opening;

FIG. 10 is a cross-sectional view of the compression connector of FIG. 9 taken from line 10-10;

DETAILED DESCRIPTION

Figure 1:
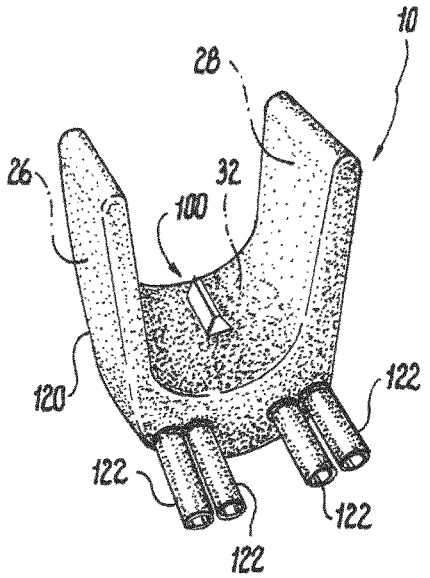
FIG. 1 is a front perspective view of an exemplary embodiment of a compression connector according to the present disclosure where a flexible insulating coating covers a connector body.

The present disclosure provides embodiments of compression connectors that are covered with a flexible insulating jacket and used to electrically and compressively connect, for example, one or more branch or tap conductors to one or more run or main conductors in such a way that either the entire solid branch conductor or one or more wire strands of the branch conductor remain within their respective opening, port, slot, channel, aperture or the like. For ease of description, the compression connector may be referred to as the "connector" in the singular and the "connectors" in the plural. The branch or tap conductors may be referred to as the "branch conductor" in the singular and the "branch conductors" in the plural. The main or run conductors may be referred to as the "run conductor" in the singular and the "run conductors" in the plural. The port, slot, channel, aperture or other opening that receives the branch conductors may also be referred to as the "branch opening" in the singular and the "branch openings" in the plural. The port, slot, channel, aperture or other opening that receives the run conductors may also be referred to as the "run opening" in the singular and the "run openings" in the plural.

Referring to FIGS. 1-3 and 6, an exemplary embodiment of a compression connector according to the present disclosure is shown. In this exemplary embodiment, the connector 10 includes a body 20 having a run conductor portion 22 and a branch conductor portion 24. The run conductor portion 22 includes two side walls 26 and 28, a run opening 30 between the two side walls and a bottom wall 32 between the two side walls 26 and 28 that define a portion of the run opening 30. The bottom wall 32 in this exemplary embodiment is a rounded bottom wall. One of the walls 26 or 28 may include a more rounded shape at its free end than the other wall so that when the connector 10 is compressed, e.g., crimped, the more rounded end can overlay the run conductor. In the exemplary embodiment shown, the run conductor portion 22 is substantially a U-shaped structure with the rounded bottom wall 32 shaped to receive a run conductor. The configuration of the opening 30 can vary depending upon the size of the run conductor. As a non-limiting example, the run conductor can be a round cable having a gauge in the range from about 250 Kcmil to about 750 Kcmil. The walls 26, 28 and 32 may include one or more channels 34 that extend along a width "W1" of the body 20. The channels 34 have a width "W2" and are configured and dimensioned to receive and releasably hold an insulation piercing member 100 to the body 20 as described in more detail below. In the exemplary embodiment shown, a channel 34 extends along a width "W1" of the bottom wall 32.

Continuing to refer to FIGS. 1-3 and 6, the run conductor portion 22 of the body 20 also includes one or more insulation piercing members 100 extending from an inner surface of one or more walls 26, 28 and/or 32. In the embodiment shown in FIGS. 1-3, an insulation piercing member 100 extends from the bottom wall 32 into the opening 30. In this exemplary embodiment, the insulation piercing member 100 includes a base 102 and a tip member 104. The base 102 is configured and dimensioned to fit within the channel 34 in wall 26, 28 and/or 32 of the body 20, as shown, so that the insulation piercing member 100 is removably attached to the body 20. More specifically, as noted above, in the exemplary embodiment shown, the channel 34 extends along the width "W1" of the bottom wall 32 of the body 20 and forms the mortise portion of a sliding dove-tail type connection joint. The base 102 of the insulation piercing member 100 is tapered to form the tenon or tongue of the sliding dove-tail connection joint. Preferably, there is sufficient friction between the channel 34 and the base 102 so that after the base 102 is inserted into the channel 34, the insulation piercing member 100 remains in position within the channel 34 for the subsequent insulation coating process described below. The base 102 has a length "L1" that is substantially the same as the width "W1" of the body 20, and a width "W3" that is substantially the same as the width "W2" of the channel 34 so that the base 102 can slide into the channel 34 and remain fixed in position due to friction between the walls of the base 102 and the walls of the channel 34.

Figure 2:
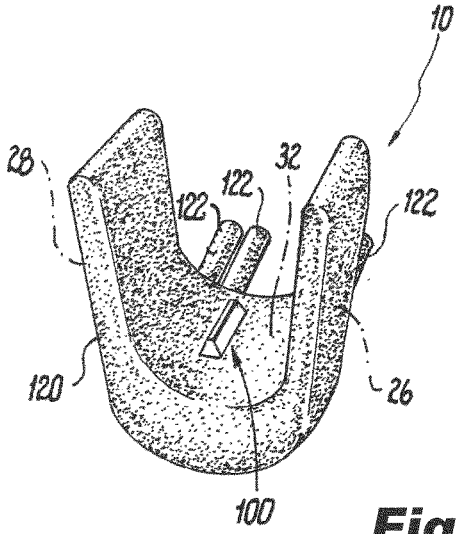
FIG. 2 is a rear perspective view of the compression connector of FIG. 1.

The tip member 104 is, in this exemplary embodiment, a triangular shaped member extending from the base 102 into the opening 30 in the body 20. More specifically, the tip member 104 includes a base side 104*a* that is integrally or monolithically formed into the base 102 and two side walls 104*b* and 104*c* extending away from the base side 104*a* and joined to form a piercing tip 104*d*. The piercing tip 104*d* is configured and dimensioned to pierce or cut through the insulation jacket surrounding the electrical wire in the run conductor 700 when the connector 10 is crimped, and to contact the electrical wire within the run conductor 700 to create an electrical path between the connector 10 and the run conductor 700, as shown in FIG. 8. The tip member 104 has a length "L2" that is less that the length "L1" of the base 102. The length "L2" of the tip member 104 should be sufficiently less than the length "L1" of the base 102 so that the insulation jacket 120, seen in FIG. 7, applied to the body 20 surrounds the base side 104*a* of the tip member 104. By having the length of the tip member 104 less than the length of the base 102, a seal can form between the connector 10 and the run conductor 700 when the run conductor 700 is crimped to the connector 10. This seal minimizes and possibly prevents water and/or gas from contacting the tip member 104 of the insulation piercing member 100. As a non-limiting example, if the length "L1" of the base 102 is 1 inch, the length "L2" of the tip member 104 would preferably be ½ inch and the tip member would be centered along the width of the body 20 as shown in FIGS. 1 and 2. As such, in this exemplary embodiment, the length "L2" of the tip member 104 is ½ the length "L1" of the base 102. In this exemplary embodiment, the body 20 is typically formed by, for example, an extrusion process, a metal casting process or a machining process where the channel 34 is formed as part of the process used to fabricate the body. The insulation piercing member 100 is typically formed by, for example, a stamping process, a metal casting process or a machining process and hardened using conventional hardening processes, such as heating and rapidly cooling the insulation piercing member.

It is noted, however, that the insulation piercing members 100 may come in different shapes and sizes configured and dimensioned to pierce or cut through insulation surrounding electrical wires, such as a cone-shaped member or a member with a pointed tip. Further, the insulation piercing members 100 may include a serrated tip to assist in the piercing through insulation surrounding the electrical wires. The insulation piercing members 100 are preferably made of a hardened material that is sufficient to pierce through insulation surrounding the run conductors 400. Non-limiting examples of such hardened material include 6000 series aluminium, stainless steel or hardened brass.

Figure 6:
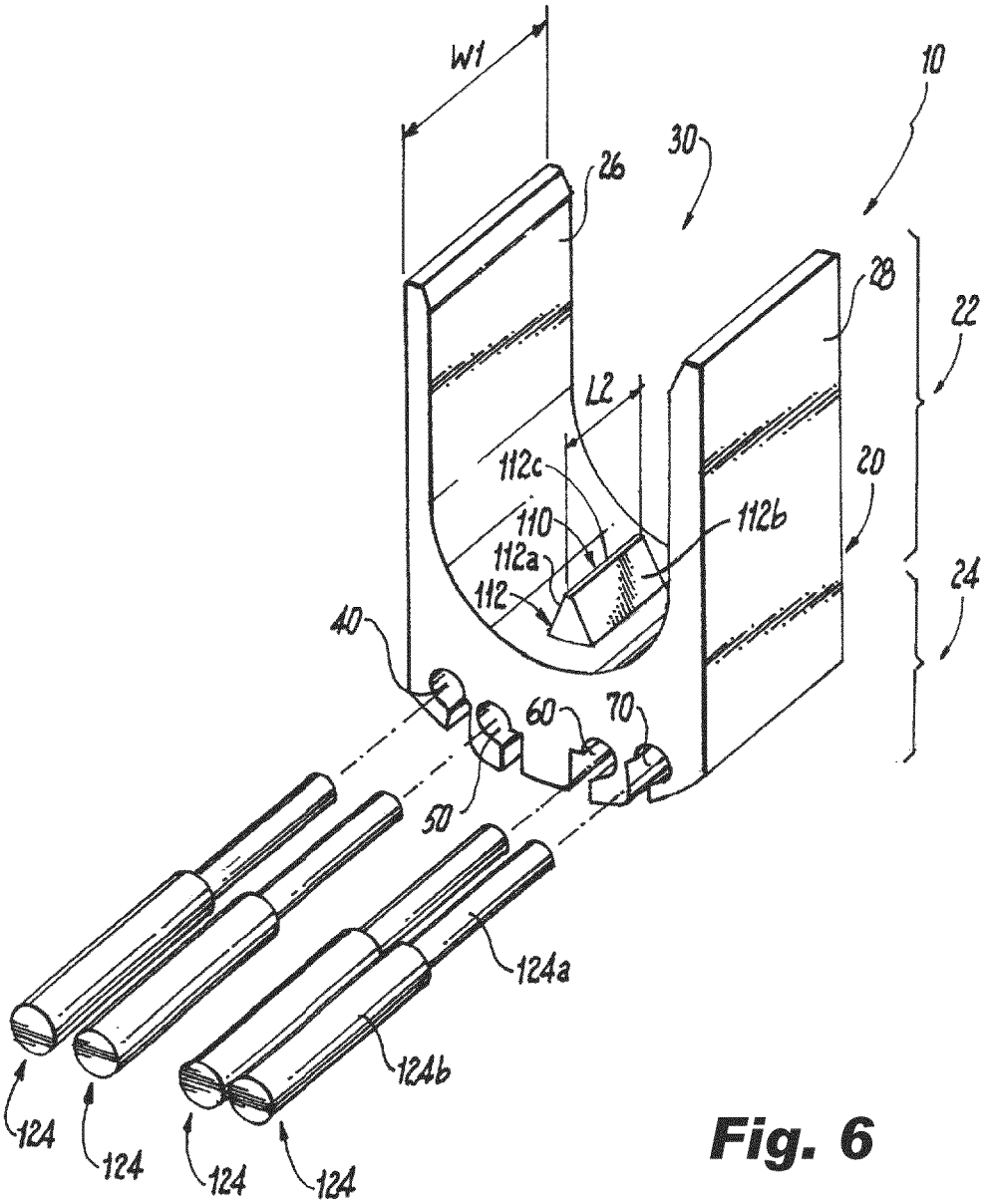
FIG. 6 is an exploded perspective view of another exemplary embodiment of the connector body of the compression connector of FIG. 1 prior to receiving the insulating coating, illustrating the connector body with an opening for receiving a conductor, an insulation piercing member integrally formed into an interior wall of the body, a plurality of branch conductor openings and a plurality of pegs used to create branch conductor portals for receiving the branch conductors.

Referring to FIG. 6, another exemplary embodiment of the body 20 of the connector 10 is shown. In this exemplary embodiment, the body 20 is substantially the same as the body described above except that the body 20 includes one or more insulation piercing members 110 integrally or monolithically formed into one or more walls 26, 28 and 32 of the body. As shown, the insulation piercing member 110 extends from the bottom wall 32 into the opening 30. In this exemplary embodiment, the insulation piercing member 110 includes tip member 112, which is substantially similar to the tip member 104 described above. The tip member 112 is, in this exemplary embodiment, a triangular shaped member extending from the bottom wall 32 of the body into the opening 30. More specifically, the tip member 112 includes two side walls 112*a* and 112*b* extending away from the bottom wall 32 of the body 20 and joined to form a piercing tip 112*c*. The piercing tip 112*c* is configured and dimensioned to pierce or cut through the insulation jacket surrounding the electrical wire in the run conductor 700 when the connector 10 is crimped, and to contact the electrical wire within the run conductor 700 to create an electrical path between the connector 10 and the run conductor 700, similar to the connection shown in FIG. 8. The tip member 112 has a length "L2" that is less that the width "W1" of the body 20. The length "L2" of the tip member 112 should be sufficiently less than the width "W1" of the body 20 so that the insulation jacket 120, seen in FIG. 7, applied to the body 20 surrounds the junction between the bottom wall 32 and the insulation piercing member 110. By having the length of the tip member 112 less than the width of the body 20, a seal can form between the connector 10 and the run conductor 700 when the run conductor is crimped to the connector 10. This seal minimizes and possibly prevents water and/or gas from contacting the tip member 112 of the insulation piercing member 110. As a non-limiting example, if the width "W1" of the body 20 is 1 inch, the length "L2" of the tip member 112 would preferably be ½ inch and the tip member would be centered along the width "W1" of the body 20 as shown in FIG. 6. As such, in this exemplary embodiment, the length "L2" of the tip member 112 is ½ the width "W1" of the body 20. In this exemplary embodiment, the body 20 is typically formed by an extrusion process, metal casting process or a machining process where the insulation piercing member 110 is formed as part of the extrusion process, metal casting process or the insulation piercing member is machined as part of the body. In order to harden the insulation piercing member 110, the insulation piercing member is put through a conventional hardening process, such as heating and then rapidly cooling the insulation piercing member.

It is noted, however, that the insulation piercing members 110 may come in different shapes and sizes configured and dimensioned to pierce or cut through insulation surrounding electrical wires, such as a cone-shaped member or a member with a pointed tip. Further, the insulation piercing members 110 may include a serrated tip to assist in the piercing through insulation surrounding the electrical wires.

Referring again to FIGS. 1-3, the branch connector portion 24 includes one or more branch openings. Each branch opening can be configured and dimensioned to receive one or more branch conductors. In the embodiment shown, the branch conductor portion 24 includes four branch conductor openings 40, 50, 60 and 70, and the branch conductors 702, 704, 706 and 708, seen in FIG. 4, are round cables. However, there may be less than four branch openings or there may be more than four branch openings.

Figure 3:
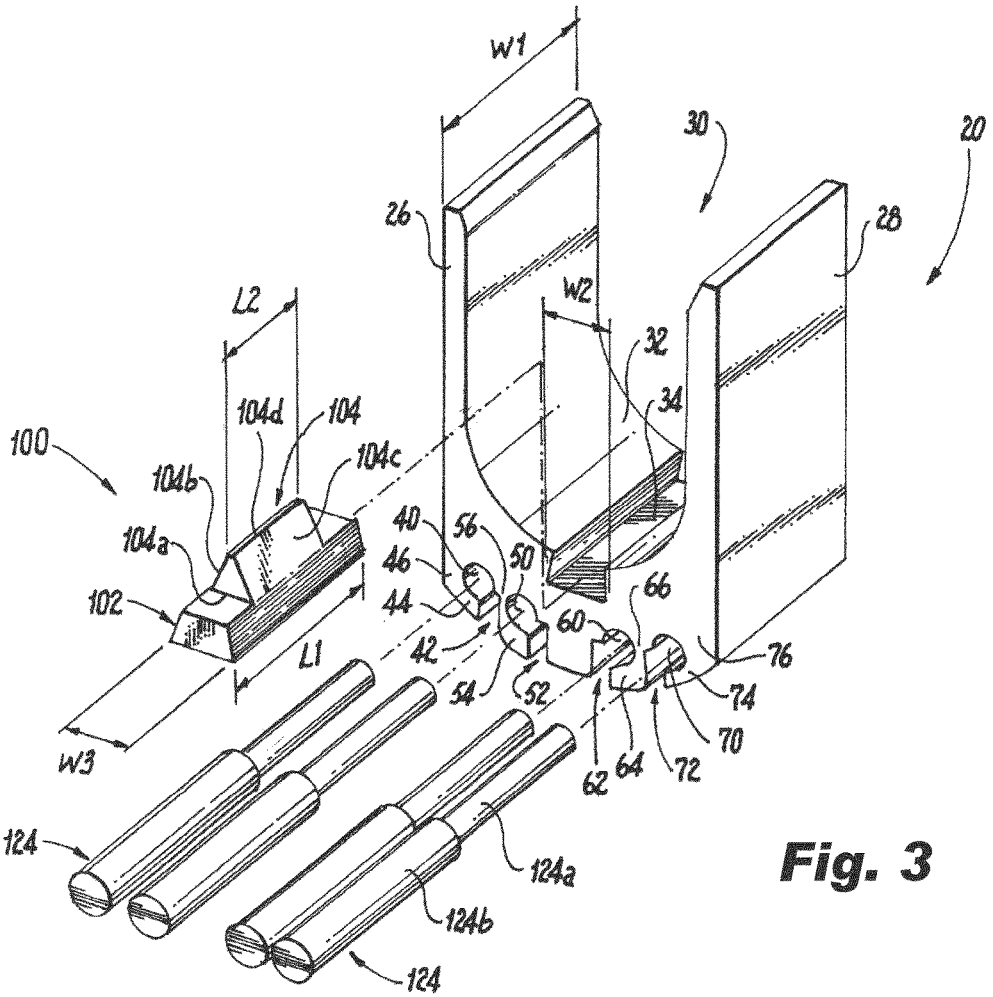
FIG. 3 is an exploded perspective view of the connector body of the compression connector of FIG. 1 prior to receiving the insulating coating, illustrating the connector body with an opening for receiving a conductor, an insulation piercing member removably attached to an interior wall of the body, a plurality of branch conductor openings and a plurality of pegs used to create branch conductor portals for receiving the branch conductors.
Figure 4:
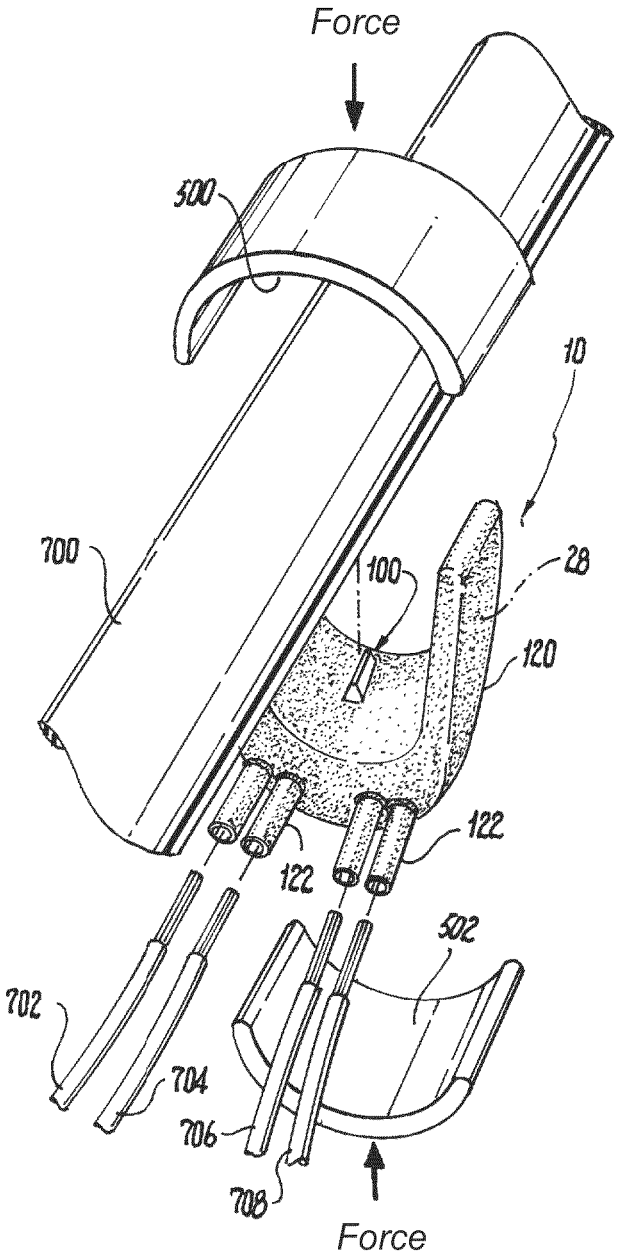
FIG. 4 is a perspective view of the compression connector of FIG. 1 positioned between a pair of dies of a hydraulic powered crimping tool with a run conductor and four branch conductors for crimping.

In the exemplary embodiment shown in FIGS. 3 and 6, the branch opening 40 extends along the width "W1" of the body 20 as shown and has a lead-in 42 defined by a rib 44. The rib 44 helps retain a branch conductor within the branch opening 40 until the connector 10 is compressed, e.g., crimped. The branch conductor portion 24 also includes a first hinge portion 46 that enables rib 44 to more easily bend or deflect in a direction toward the bottom wall 32 of the body 20 when being compressed. The branch opening 50 extends along the width "W1" of the body 20 as shown and has a lead-in 52 defined by a rib 54. The rib 54 helps retain a branch conductor within the branch opening 50 until the connector 10 is compressed, e.g., crimped. The branch conductor portion 24 also includes a second hinge portion 56 that enables rib 54 to more easily bend or deflect in a direction toward the bottom wall 32 of the body 20 when being compressed. The branch opening 60 extends along the width "W1" of the body 20 as shown and has a lead-in 62 defined by a rib 64. The rib 64 helps retain a branch conductor within the branch opening 60 until the connector 10 is compressed, e.g., crimped. The branch conductor portion 24 also includes a third hinge portion 66 that enables rib 64 to more easily bend or deflect in a direction toward the bottom wall 32 of the body 20 when being compressed. Branch opening 70 extends along the width "W1" of the body 20 as shown and has a lead-in 72 defined by a rib 74. The rib 74 helps retain a branch conductor within the branch opening 70 until the connector 10 is compressed, e.g., crimped. The branch conductor portion 24 also includes a fourth hinge portion 76 that enables rib 74 to more easily bend or deflect in a direction toward the bottom wall 32 of the body 20 when being compressed. Each branch opening includes an interior wall that is configured to contact an electrical wire within a respective branch conductor to create an electrically conductive path between the branch conductor and the connector body 20.

When the connector 10 is compressed, using for example a standard hydraulic crimping tool (not shown), the hinge portions 46, 56, 66 and 76 of the branch conductor portion 24 bend or deflect first to prevent the branch conductors or strands of the branch conductors from exiting the respective opening via lead-ins 42, 52, 62 and 72. It is noted that the branch openings 40, 50, 60 and 70 shown are substantially the same size. As a result, the branch openings would be configured to receive branch conductors 702, 704, 706 and 708 having a size or gauge that falls with the same predefined range of, for example, #22 AWG to 4/0 AWG. However, the present disclosure also contemplates that one or more the branch openings 40, 50, 60 and 70 may have different sizes. For example, one or more branch openings could be configured to receive branch conductors having a first size or gauge that falls with a first predefined range of, for example, 1/0 AWG, and one or more branch openings could be configured to receive branch conductors having a second size or gauge that falls with a second predefined range of, for example, 4/0 AWG.

Figure 5:
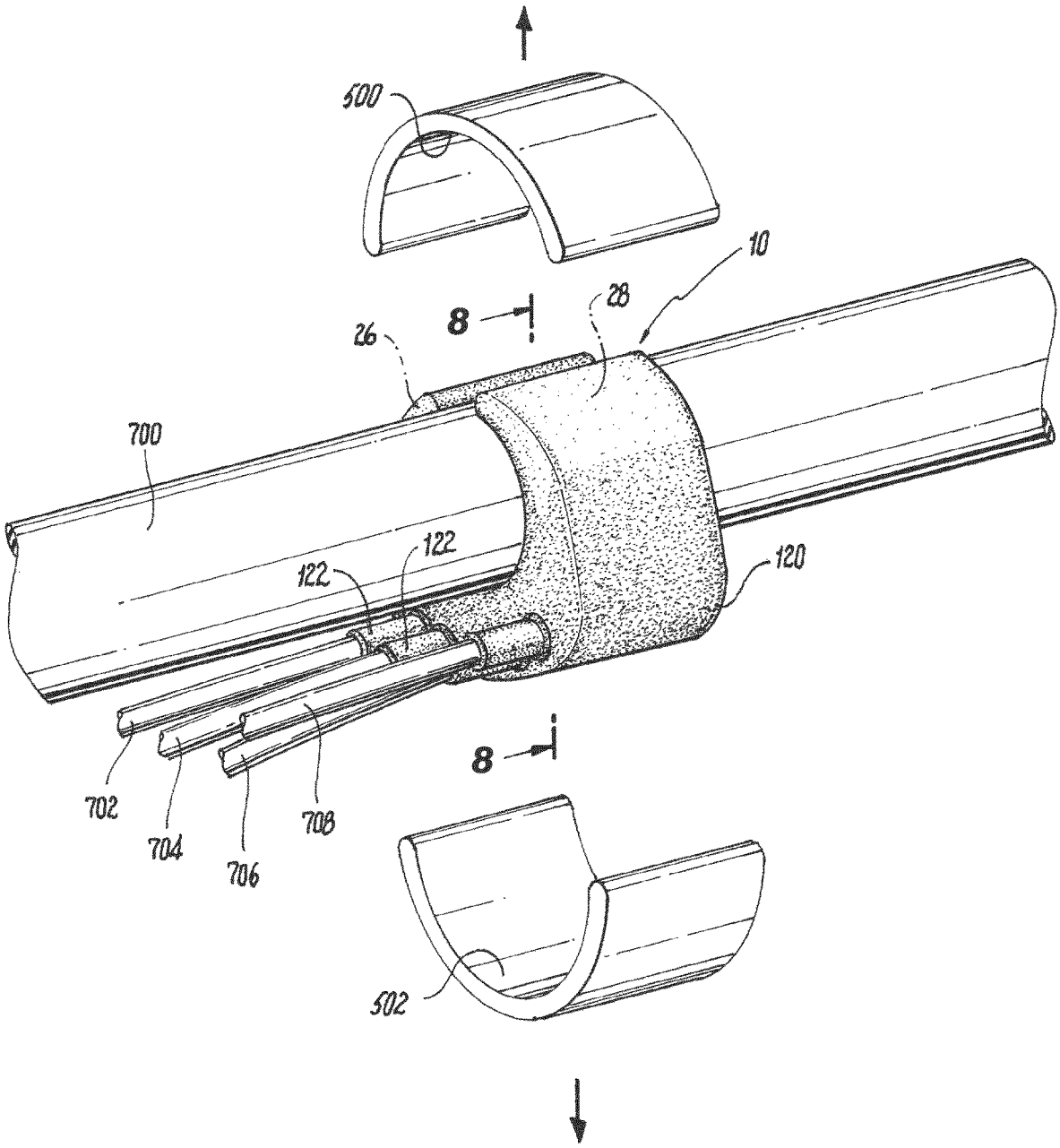
FIG. 5 is a perspective view of the compression connector of FIG. 4 where the compression connector has been subjected to a crimping operation to electrically connect a run conductor to four branch conductors and the dies of the crimping tool being removed.

Referring to FIGS. 4 and 5, it is noted that the run conductors 700 are typically greater in size or gauge than the branch conductors 702, 704, 706 and 708. The run conductors 700 and the branch conductors include electrical wires surrounded by an insulating jacket. Further, the electrical wires in the run conductors 700 and the branch conductors 702, 704, 706 and 708 can be solid wires so that the run or branch conductors would be known as solid conductors. Alternatively, the electrical wires in the run conductors 700 and the branch conductors 702, 704, 706 and 708 can be stranded wires so that the run or branch conductors would be known as stranded conductors. Typically, the run conductors and branch conductors are stranded conductors, as shown.

Once the connector body 20 is formed, the connector body, including the insulation piercing members 100 or 110, is coated with a flexible insulating material to form the insulation jacket 120 around the connector body 20. At the same time, branch conductor portals 122 that are aligned with the branch openings 40, 50, 60 and 70 are formed in the insulation jacket 120 to provide a seal between the insulation jacket surrounding the electrical wire in the branch conductors. This seal minimizes and possibly prevents water and/or gas from entering the branch conductor openings. Non-limiting examples of the flexible insulating material include Polyvinyl Chloride (PVC), ethylene propylene diene monomer (EPDM) rubber, Santoprene and Plastisol.

To coat the conductor body 20 with the flexible insulating material and to form the branch conductor portals 122, pegs 124 are first inserted into the branch openings 40, 50, 60 and 70, as seen in FIGS. 3 and 6. Each peg 124 includes a first portion 124*a* and a second portion 124*b*. In this exemplary embodiment, the first portion 124*a* is a cylindrical member shaped to conform to the branch openings 40, 50, 60 and 70. The first portion 124*a* has an outer diameter configured to fit within the respective branch opening. However, the first portion may have other shapes to conform to the shape of the branch openings 40, 50, 60 and 70. Similarly, the second portion 124*b* is a cylindrical member shaped to conform to the insulation jacket surrounding electrical wire in the branch conductors 702, 704, 706 and/or 708. The second portion 124*b* of each peg 124 has an outer diameter configured to form the branch conductor portals 122 made of the flexible insulating material. In this configuration, the inner diameter of the branch conductor portals 122 would be the same or slightly less than the outer diameter of the insulation jacket surrounding the electrical wire in the branch conductors 702, 704, 706 and/or 708 so that when the branch conductors are inserted into the branch conductor portals 122 a seal is formed between the branch conductor insulating jacket and the branch conductor portal 122. This seal minimizes and possibly prevents water and/or gas from entering the branch conductor openings. However, the second portion 124*b* may have other shapes to conform to the shape of the insulation jacket surrounding the electrical wires in branch conductors 702, 704, 706, 708.

With the pegs 124 inserted into the branch openings 40, 50, 60 and 70, the conductor body 20 is coated with the flexible insulating material, by for example, dipping the conductor body into a vat of liquid insulating material and then allowing the coating of insulating material to harden to form the insulation jacket 120, or by an injection moulding process. Once the coating hardens, the portion of the insulating jacket 120 covering the tip member 104 or 112 of the insulation piercing member 100 or 110, respectively, is removed to expose the insulation piercing member, as seen in FIG. 7.

Referring now to FIGS. 4, 5 and 8, to secure the run and branch conductors to the connector 10, the connector is placed in a standard crimping tool (not shown), such as a hydraulic 12-ton or 15-ton hand held power tool, that has die surfaces 500 and 502, seen in FIGS. 4 and 5, in a working head of the tool. An example of a hydraulic power tool is the PAT46-18V manufactured by Burndy, LLC. When the tool is actuated, the connector 10 would come into contact with the interior surfaces of the dies, such that a compressive force applied to the dies is transferred to the connector 10 causing the connector to compress. As the tool is compressing the connector 10, the hinges 46, 56, 66, and 76 would typically bend or deflect first securing the branch conductors 702, 704, 706 and 708 within their respective branch openings 40, 50, 60 and 70 and preventing strands of the branch conductors from exiting the openings. As additional compressive force is applied to the connector 10, the wall 26 folds and then the wall 28 folds to secure the run conductor 700 to the connector. In addition, the insulation piercing members 100 or 110 would pierce through the run conductor insulation jacket so that an electrical path is formed between the electrical wire in the run conductor and the body 20. The conductors provided in branch openings 30, 40, 50, 60 and 70 will receive direct compressive loads due to the unique geometric relationship between the connector 10 and the dies of the tool. After the crimping process is completed, the conductors 700, 702, 704, 706 and 708 provided in their respective openings would be secured in place, i.e., crimped to the connector 10.

The body 20 of the connector 10 described in the present disclosure can be manufactured from copper, aluminum or similar metallic materials which would appropriately deform when pressure is applied in standard mechanical, hydraulic and pneumatic crimping tools and devices to crimp the conductors to the connectors. The insulation piercing members described herein are preferably made of a hardened material or hardened so that the insulation piercing members are sufficient to pierce through the insulation jacket surrounding the run conductors. Further, the branch openings disclosed and described herein may also include one or more insulation piercing members, similar to the insulation piercing members described herein, that are configured and dimensioned to pierce the insulation jacket surrounding electrical wire in the branch conductors.

Figure 11:
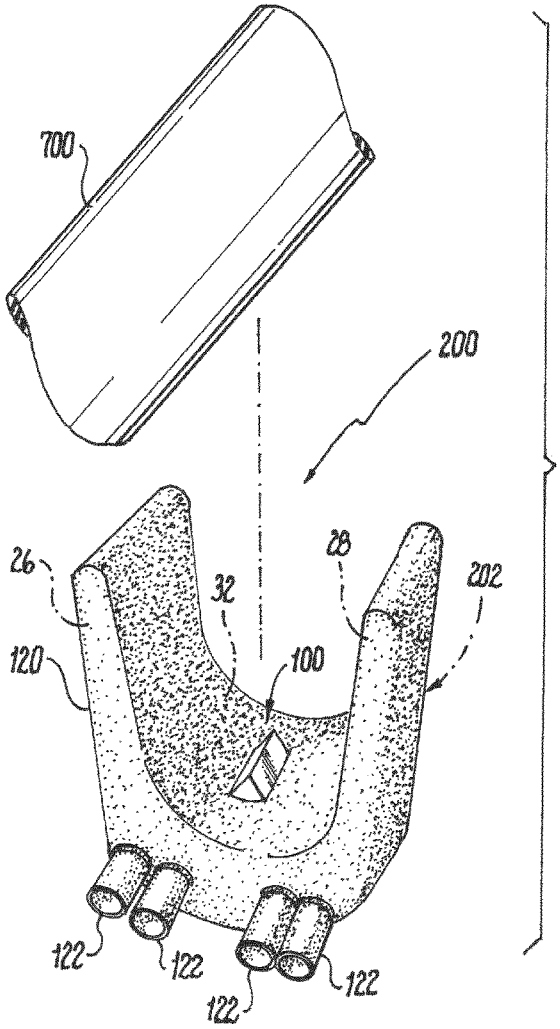
FIG. 11 is a front perspective view of the compression connector of FIG. 9, illustrating a flexible insulating coating covering the connector body.
Figure 12A:
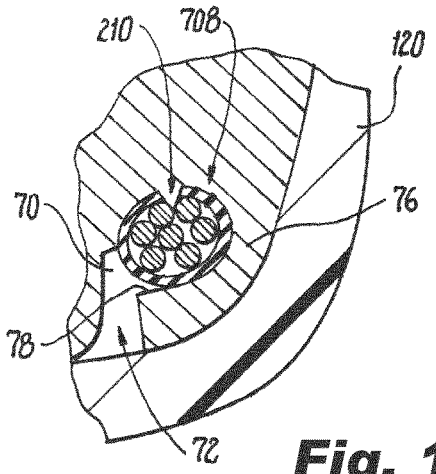
FIG. 12*a* is an enlarged view of a portion of the compression connector of FIG. 12 taken from detail 12*a*, illustrating an insulation piercing member extending into a branch conductor opening and piercing through an insulating jacket of a branch conductor.
Figure 12:
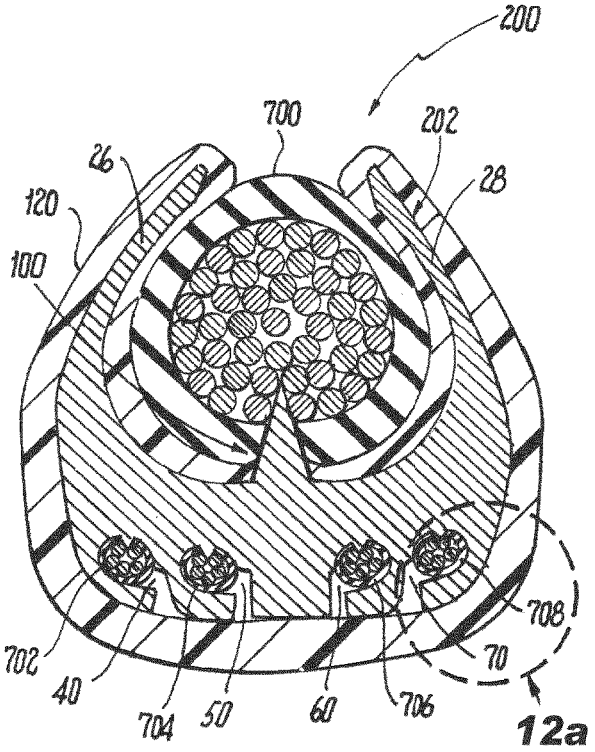
FIG. 12 is a midpoint cross-sectional view of the compression connector of FIG. 11 taken from line 12-12, illustrating a run conductor in the a run conductor opening, a branch conductor in each branch conductor opening and the compression connector having been subjected to a crimping operation to electrically and compressively connect the run conductor to the branch conductors.

Referring to FIGS. 9-12*a*, another exemplary embodiment of a body 202 of a connector 200 is shown. In this exemplary embodiment, the body 202 is substantially the same as the body 20 described above except that the branch connector portion 24 of the body 202 includes one or more branch openings, e.g., branch openings 40, 50, 60 and 70, and each branch opening includes one or more insulation piercing members 210 integrally or monolithically formed into the branch opening. As shown in FIGS. 9 and 10, each insulation piercing member 210 extends from an interior wall of the respective branch opening. In the embodiment shown, the branch conductor portion 24 includes four branch openings 40, 50, 60 and 70, and the branch conductors 702, 704, 706 and 708, seen in FIG. 12, are round cables. However, there may be less than four branch openings or there may be more than four branch openings. The branch opening 40 includes an interior wall 48 and one or more insulation piercing members 210 extending from the interior wall 48 into the branch opening 40. The branch opening 50 includes an interior wall 58 and one or more insulation piercing members 210 extending from the interior wall 58 into the branch opening 50. The branch opening 60 includes an interior wall 68 and one or more insulation piercing members 210 extending from the interior wall 68 into the branch opening 60. The branch opening 70 includes an interior wall 78 and one or more insulation piercing members 210 extending from the interior wall 78 into the branch opening 70. For ease of description, the one or more insulation piercing members 210 extending from the interior wall 78 into the branch conductor opening 70 will be described in more detail. However, this description applies to branch openings 40, 50 and 60 as well.

Referring to FIGS. 9 and 10, one or more insulation piercing members are shown extending from an interior wall of the respective branch opening. As shown in FIG. 9, one insulation piercing member 210 extends from the interior wall 78 into the branch opening 70. The insulation piercing member 210 may have a length that is substantial equal to the width "W1" of the body 202, seen in FIG. 9, or the insulation piercing member 210 may have a length that is less than the width "W1" of the body 202. In other embodiments, the insulation piercing member 210 extending from the interior wall 78 into the branch opening 70 may be segmented so that more than one insulation piercing members may extend from the interior wall 78 into the branch opening 70.

Referring again to FIGS. 9-12*a*, in this exemplary embodiment, each insulation piercing member 210 includes tip member 212. The tip member 212 is, in this exemplary embodiment, a triangular shaped member extending from the interior wall of the respective branch opening, e.g. interior wall 78 of branch opening 70. More specifically, the tip member 212 includes two side walls 212*a* and 212*b* extending away from the interior wall 78 of the branch conductor opening 70 and are joined to form a piercing tip 212*c*. The piercing tip 212*c* is configured and dimensioned to pierce or cut through the insulation jacket surrounding the electrical wire of the branch conductor, e.g., branch conductor 708, when the connector 200 is crimped, and to contact the electrical wire within the branch conductor 708 to create an electrical path between the connector 200 and the respective branch conductor, similar to the connection shown in FIGS. 12 and 12*a*.

Although the insulation piercing members 210 are described herein as a triangular shaped member, the insulation piercing members 210 may come in different shapes and sizes configured and dimensioned to pierce or cut through insulation surrounding electrical wires, such as a cone-shaped member or a member with a pointed tip. Further, the insulation piercing members 210 may include a serrated tip to assist in the piercing through insulation surrounding the electrical wires.

Once the connector body 202 is formed, the connector body is coated with a flexible insulating material to form the insulation jacket 120 around the connector body 202, seen in FIG. 11. At the same time, branch conductor portals 122 that are aligned with the branch openings 40, 50, 60 and 70 are formed in the insulation jacket 120 to provide a seal between the insulation jacket surrounding the electrical wire of the branch conductors and the insulation jacket 120. This seal minimizes and possibly prevents water and/or gas from entering the branch openings. Non-limiting examples of the flexible insulating material include Polyvinyl Chloride (PVC), ethylene propylene diene monomer (EPDM) rubber, Santoprene and Plastisol. The insulation jacket 120 and the branch conductor portals 122 can be formed in a similar manner as described above, except that the first portion 124*a* of each peg 124 inserted into a branch opening 40, 50, 60 and/or 70 to facilitate the formation of the branch conductor portals 122 differ slightly. More specifically, the first portion 124*a* of each peg 124 includes a notch 124*c* configured to receive the insulation piercing members 210 within the respective branch opening 40, 50, 60 and/or 70.

Figure 13:
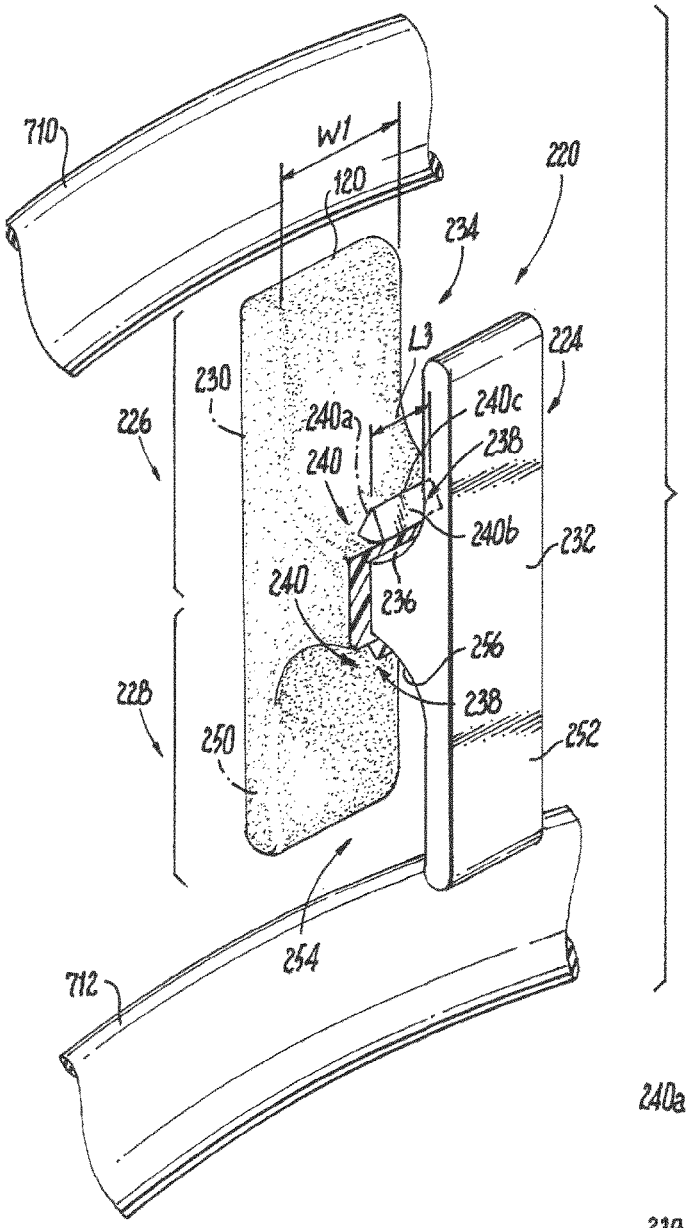
FIG. 13 is a perspective view of another exemplary embodiment of a compression connector according to the present disclosure, illustrating an H-shaped connector body with a portion of the flexible insulating coating removed, with openings for receiving conductors, and with insulation piercing members integrally formed into the body and extending into the openings.
Figure 14:
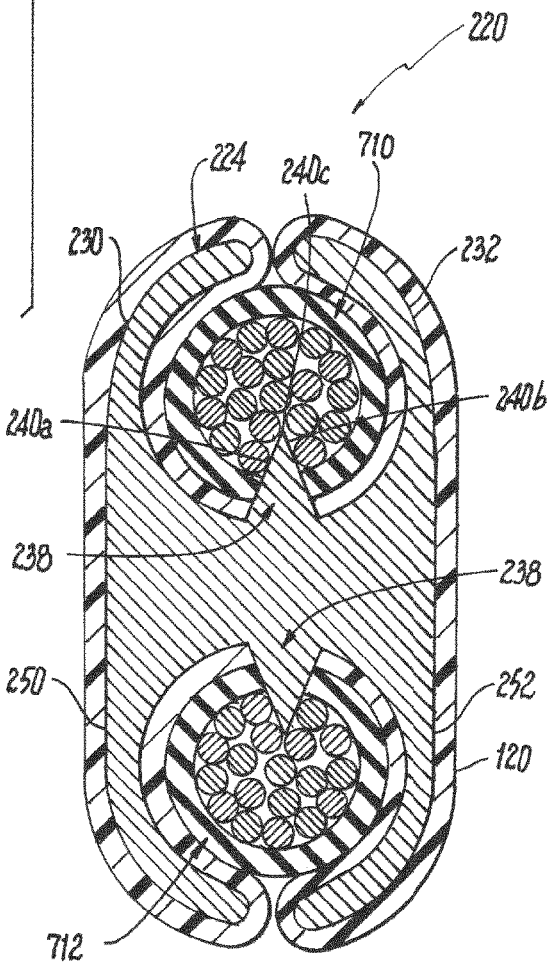
FIG. 14 is a midpoint cross-sectional view of the compression connector of FIG. 13 taken from line 14-14, illustrating conductors positioned within the connector body openings and the compression connector having been subjected to a crimping operation to electrically and compressively connect the conductors.

Referring now to FIGS. 13 and 14, another exemplary embodiment of a connector according to the present disclosure is shown. In this exemplary embodiment, the connector 220 is an H-shape like member having a body 224. The body 224 includes a run conductor portion 226 and a branch conductor portion 228. The run conductor portion 226 includes two side walls 230 and 232, an opening 234 between the side walls 230 and 232, and a bottom wall 236 between the side walls 230 and 232 that define a portion of the opening 234. One of the walls 230 or 232 may include a more rounded shape at its free end than the other wall so that when the connector 220 is compressed, e.g., crimped, the more rounded end can overlay a conductor within the opening 234. The first conductor portion 226 of the connector 220 also includes one or more insulation piercing members 238 integrally or monolithically formed into one or more walls 230, 232 and/or 236 and extending into the opening 234. However, the one or more insulation piercing members 238 may be separate members secured to the connector body 224 using, for example, the above-described sliding dove-tail type connection joint. In the embodiment shown, a single insulation piercing member 238 is monolithically formed in the connector body 224 so that the insulation piercing member extends from the bottom wall 236 into the opening 234.

The branch conductor portion 228 of the body 224 includes two side walls 250 and 252, an opening 254 between the side walls 250 and 252, and a bottom wall 256 between the side walls 250 and 252 that define a portion of the opening 254. It is noted that the bottom wall 256 is opposite the bottom wall 236. One of the walls 250 or 252 may include a more rounded shape at its free end than the other wall so that when the connector 220 is compressed, e.g., crimped, the more rounded end can overlay a conductor within the opening 254. The second conductor portion 228 of the connector 220 also includes one or more insulation piercing members 238 integrally or monolithically formed into one or more walls 250, 252 and/or 256 and extending into the opening 254. However, the one or more insulation piercing members 238 may be separate members secured to the connector body 224 using, for example, the above-described sliding dove-tail type connection joint. In the embodiment shown, a single insulation piercing member 238 is monolithically formed in the connector body 224 so that the insulation piercing member extends from the bottom wall 256 into the opening 254.

Each insulation piercing member 238 includes a tip member 240 that is, in this exemplary embodiment, a triangular shaped member extending from the bottom wall 236 or 256 of the body 224 into the opening 234 or 254. More specifically, the tip member 240 includes two side walls 240*a* and 240*b* extending away from the bottom wall 236 or 356 of the body 224 and are joined to form a piercing tip 240*c*. The piercing tip 240*c* is configured and dimensioned to pierce or cut through the insulation jacket surrounding the electrical wire in a run conductor 700 or a branch conductor 710 when the connector 10 is crimped, and to contact the electrical wire within the run conductor 700 or the branch conductor 710 to create an electrical path between the connector 220 and the conductors 700 and 710, similar to the connection shown in FIG. 18.

The tip member 240 has a length "L3" that is less that the width "W1" of the body 224. The length "L3" of the tip member 240 should be sufficiently less than the width "W1" of the body 224 so that the insulation jacket 120 applied to the body 224 surrounds the junction between the bottom wall 236 and 256 and the insulation piercing member 238. By having the length of the tip member 240 less than the width "W1" of the body 224, a seal can form between the connector 220 and a run conductor 710 or a branch conductor 712 when the conductor is crimped to the connector 220. This seal minimizes and possibly prevents water and/or gas from contacting the insulation piercing member 238. As a non-limiting example, if the width "W1" of the body 224 is 1 inch, the length "L3" of the tip member 240 would preferably be ½ inch and the tip member 238 would be centered along the width "W1" of the body 224 as shown in FIG. 13. As such, in this exemplary embodiment, the length "L3" of the tip member 240 is ½ the width "W1" of the body 224. In this exemplary embodiment, the body 224 is typically formed by an extrusion process, metal casting process or a machining process where each insulation piercing member 238 is formed as part of the extrusion process, metal casting process, or each insulation piercing member is machined as part of the body 224. In order to harden the insulation piercing members 238, the insulation piercing members may be put through a conventional hardening process, such as heating and then rapidly cooling the insulation piercing member.

Although the insulation piercing members 238 are described above as a triangular shaped member, the insulation piercing members 238 may come in different shapes and sizes configured and dimensioned to pierce or cut through insulation surrounding electrical wires, such as a cone-shaped member or a member with a pointed tip. Further, the insulation piercing members 238 may include a serrated tip to assist in the piercing through the insulation jacket surrounding the electrical wires.

Once the connector body 224 is formed, the connector body, including the insulation piercing members 238, are coated with a flexible insulating material to form the insulation jacket 120 around the connector body 224 that permits a seal to form between the connector body 224 and a run conductor 710 or a branch conductor 712 when the conductors are crimped to the connector 220. This seal minimizes and possibly prevents water and/or gas from contacting the insulation piercing members 238. Non-limiting examples of the flexible insulating material include Polyvinyl Chloride (PVC), ethylene propylene diene monomer (EPDM) rubber, Santoprene and Plastisol.

In one exemplary embodiment, to coat the conductor body 224 with the flexible insulating material, the conductor body 224 is, for example, dipped into a vat of liquid insulating material and then removed allowing the coating of insulating material to harden to form the insulation jacket 120. In another exemplary embodiment, the conductor body 224 may be coated with the flexible insulating material by an injection moulding process. Once the coating hardens, the portion of the insulating jacket 120 covering the tip members 240 of the insulation piercing members 238 is removed to expose the tip members 240, as seen in FIG. 13.

Figure 15:
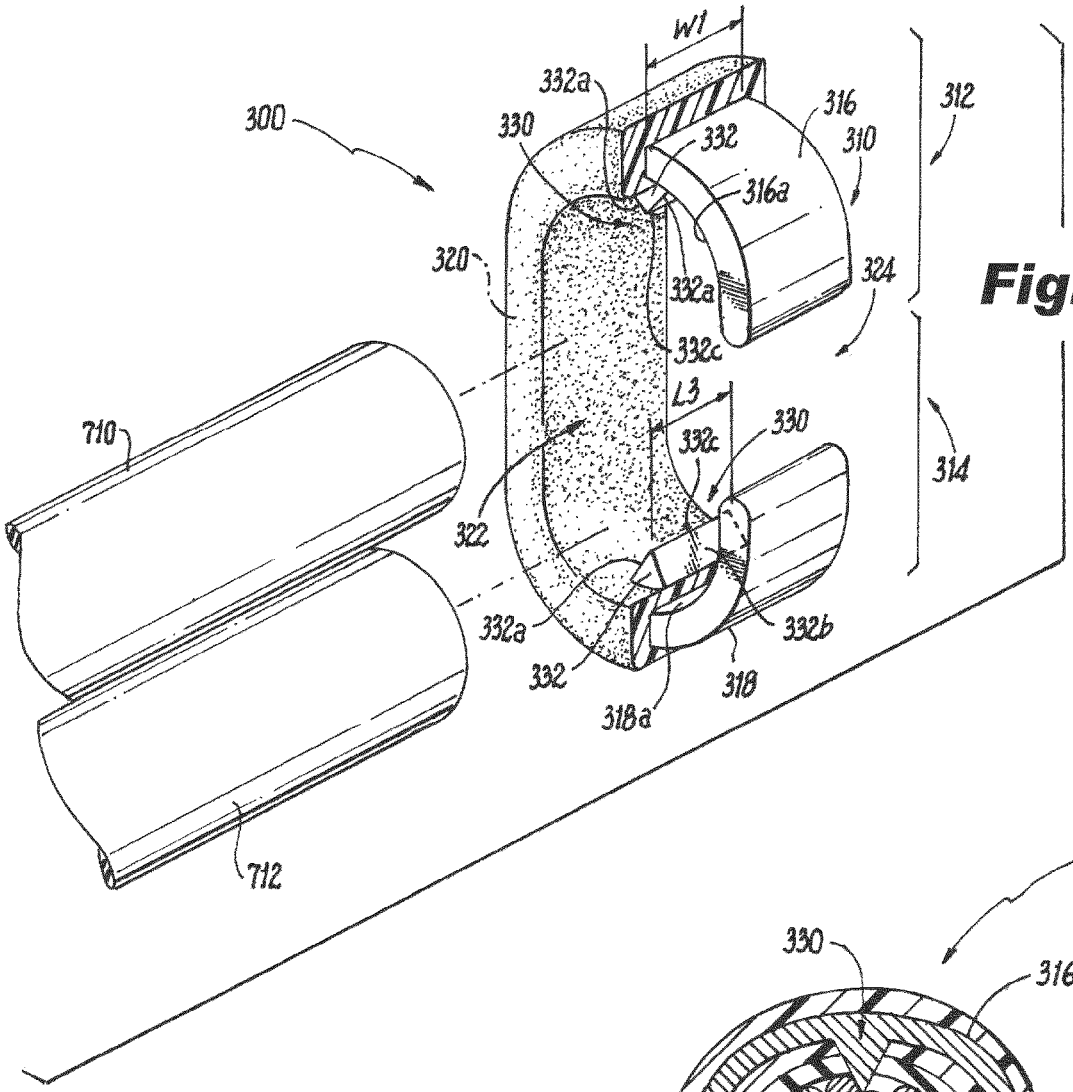
FIG. 15 is a perspective view of another exemplary embodiment of a compression connector according to the present disclosure, illustrating a C-shaped connector body with a portion of the flexible insulating coating removed, with an opening for receiving conductors, and with insulation piercing members integrally formed into the body and extending into the opening.
Figure 16:
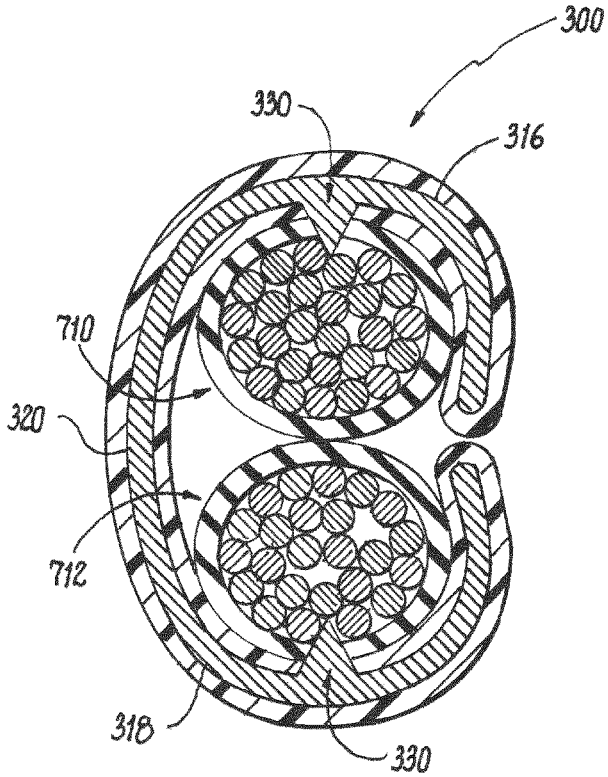
FIG. 16 is a midpoint cross-sectional view of the compression connector of FIG. 15 taken from line 16-16, illustrating conductors positioned within the connector body opening and the compression connector having been subjected to a crimping operation to electrically and compressively connect the conductors.

Referring now to FIGS. 15 and 16, another exemplary embodiment of a connector according to the present disclosure is shown. In this exemplary embodiment, the connector 300 includes a body 310 having a run conductor portion 312 and a branch conductor portion 314. The body 310 is a C-shaped like member having a first wall 316, a second wall 318 and a third wall 320 joining the first wall to the second wall. As such, the first wall 316 and a portion of the third wall 320 form the run conductor portion 312, and the second wall 318 and a portion of the third wall 320 form the branch conductor portion 314. The first, second and third walls 316, 318 and 320 may be a unitary or monolithic structure, or the walls 316, 318 and 320 may be separate walls joined together by, for example, welds. The body 310 also includes an opening 322 and a lead-in 324 between the first and second walls 316 and 318. The lead-in 324 is configured and dimensioned to permit a run conductor 710 and a branch conductor 712 to pass into and be received by the opening 322. It is noted that in the exemplary embodiment shown in FIGS. 15 and 16, the run conductor portion 312 and the branch conductor portion 314 are configured and dimensioned with inner surfaces 316*a* and 318*a* shaped to receive conductors, e.g., a run conductor 710 and a branch conductor 712. The configuration of the openings 322 and the lead-in 324 can vary depending upon the size of the conductor to be crimped. As a non-limiting example, the conductor can range from about 250 Kcmil to about 750 Kcmil.

Figure 19:
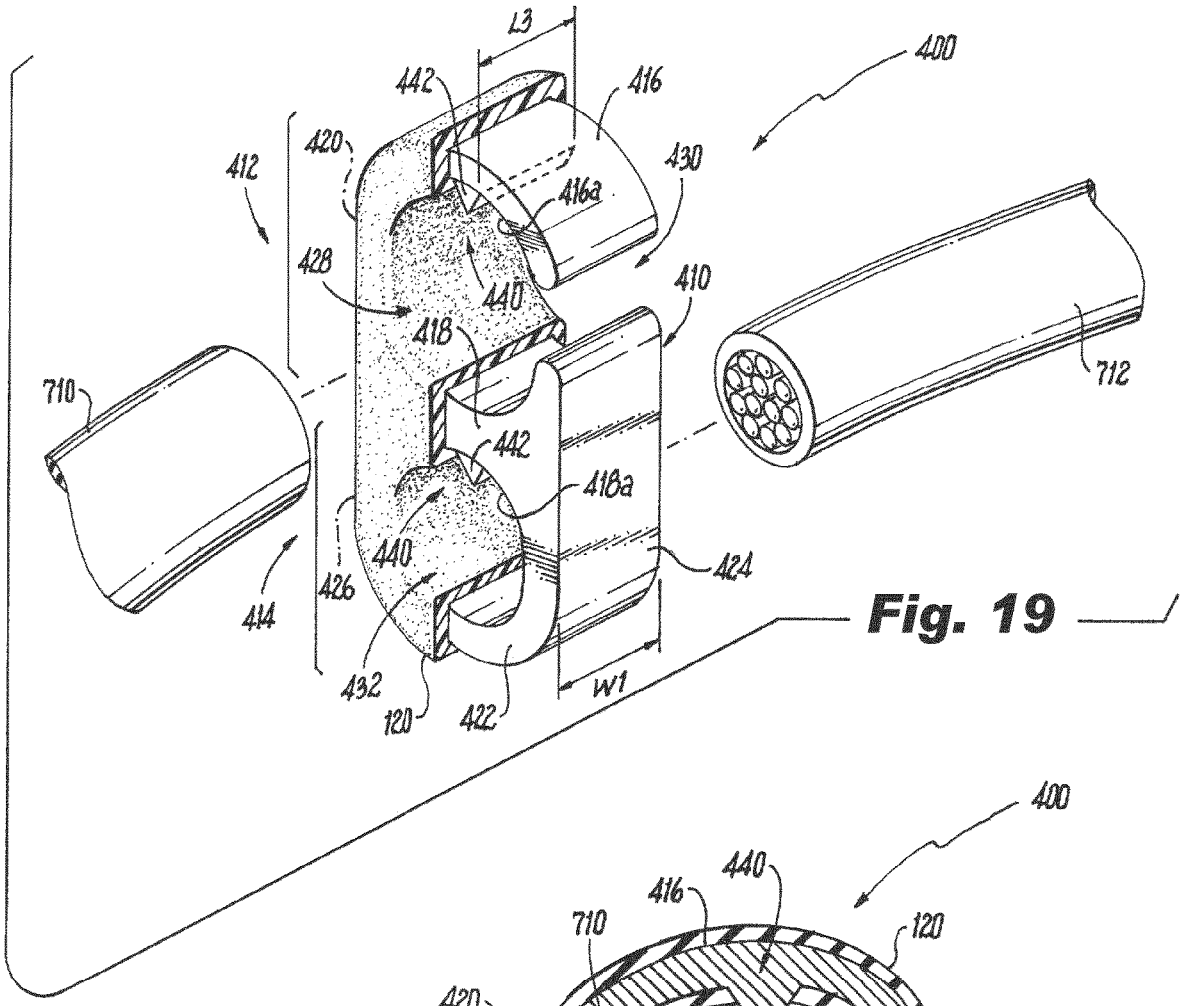
FIG. 19 is a perspective view of another exemplary embodiment of a compression connector according to the present disclosure, illustrating a connector body with a portion of the flexible insulating coating removed, with openings for receiving conductors, and with insulation piercing members integrally formed into the body and extending into the openings.

The first wall 316, in this exemplary embodiment, is a U-shaped like structure configured such that when a run conductor 710 is passed into the opening 322 via lead-in 324, the connector 300 can rest on the run conductor 710 prior to a crimping operation. The second wall 318, in this exemplary embodiment, is a U-shaped like structure configured to receive at least partially a branch conductor 712 passed into the opening 322 via lead-in 324, as seen in FIG. 19. This permits a technician to set-up and operate a crimping tool without having to hold the connector 300 as well.

The connector 300 may also include one or more insulation piercing members 330 extending from an inner surface of the one or more walls 316, 318 and/or 320 of the body 310. In the embodiment shown, a single insulation piercing member 330 extends from an inner surface 316*a* of the first wall 316 into the opening 322, and a single insulation piercing member 330 extends from an inner surface 318*a* of the second wall 318 into the opening 322. The one or more insulation piercing members 330 may be integrally or monolithically formed into one or more walls 316, 318 and/or 320 and extend into the opening 322. However, the one or more insulation piercing members 330 may be separate members secured to the connector body 310 using, for example, the above-described sliding dove-tail type connection joint. In the embodiment shown, a single insulation piercing member 330 is monolithically formed in the first wall 316 of the connector body 310, and a single insulation piercing member 330 is monolithically into the second wall 318 of the conductor body 310 so that the insulation piercing members 330 extend from the respective walls 316 and 318 into the opening 322.

Each insulation piercing member 330 includes a tip member 332 that is configured and dimensioned to pierce or cut through the insulation jacket surrounding a run conductor 710 or the branch conductor 712 when the connector 300 is crimped such that the electrical wires within the conductors 710 and 712 contact the respective insulation piercing member 330 to create an electrical path between the connector 300, the run conductor 710 and the branch conductor 712, similar to the connection shown in FIG. 16. Each tip member 332 is, in this exemplary embodiment, a triangular shaped member extending from the respective wall 316 or 318 of the body 310 into the opening 322. More specifically, the tip member 332 includes two side walls 332*a* and 332*b* extending away from the wall 316 or 318 of the body 310 and are joined to form a piercing tip 332*c*. The piercing tip 332*c* is configured and dimensioned to pierce or cut through the insulation jacket surrounding the electrical wire in a run conductor 710 or a branch conductor 712 as noted above.

Each tip member 332 has a length "L3" that is less that the width "W1" of the body 310. The length "L3" of the tip member 332 should be sufficiently less than the width "W1" of the body 310 so that the insulation jacket 120 applied to the body 310 surrounds the junction between the walls 316 and 318 and the insulation piercing members 330. By having the length "L3" of the tip members 332 less than the width of the body 310, a seal can form between the connector 300 and a run conductor 710 or a branch conductor 712 when the conductor is crimped to the connector 300. This seal minimizes and possibly prevents water and/or gas from contacting each insulation piercing member 330. As a non-limiting example, if the width "W1" of the body 310 is about 1 inch, the length "L3" of the tip member 332 would preferably be about ½ inch and the tip member 332 would be centered along the width "W1" of the body 310 as shown in FIG. 15. As such, in this exemplary embodiment, the length "L3" of the tip member 332 is ½ the width "W1" of the body 310. In this exemplary embodiment, the body 332 is typically formed by an extrusion process, metal casting process or a machining process where the insulation piercing members 310 are formed as part of the extrusion process, metal casting process or the insulation piercing member is machined as part of the body 310. In order to harden the insulation piercing members 330, the insulation piercing members can be put through a conventional hardening process, such as heating and then rapidly cooling the insulation piercing member.

Although the insulation piercing members 330 are described above as a triangular shaped members, the insulation piercing members 330 may come in different shapes and sizes configured and dimensioned to pierce or cut through insulation surrounding electrical wires, such as a cone-shaped member or a member with a pointed tip. Further, the insulation piercing members 330 may include a serrated tip to assist in the piercing through insulation surrounding the electrical wires.

Once the connector body 310 is formed, the connector body, including the insulation piercing members 330, are coated with a flexible insulating material to form the insulation jacket 120 around the connector body 310 that permits a seal to form between the connector body 310 and a run conductor 700 or a branch conductor 710 when the conductors are crimped to the connector 300. This seal minimizes and possibly prevents water and/or gas from contacting the insulation piercing members 330. Non-limiting examples of the flexible insulating material include Polyvinyl Chloride (PVC), ethylene propylene diene monomer (EPDM) rubber, Santoprene and Plastisol.

In one exemplary embodiment, to coat the conductor body 310 with the flexible insulating material, the conductor body 310 is, for example, dipped into a vat of liquid insulating material and then removed allowing the coating of insulating material to harden to form the insulation jacket 120. In another exemplary embodiment, the conductor body 310 may be coated with the flexible insulating material by an injection moulding process. Once the coating hardens, the portion of the insulating jacket 120 covering the tip members 332 of the insulation piercing members 330 is removed to expose the tip members 332, as seen in FIG. 15.

Figure 17:
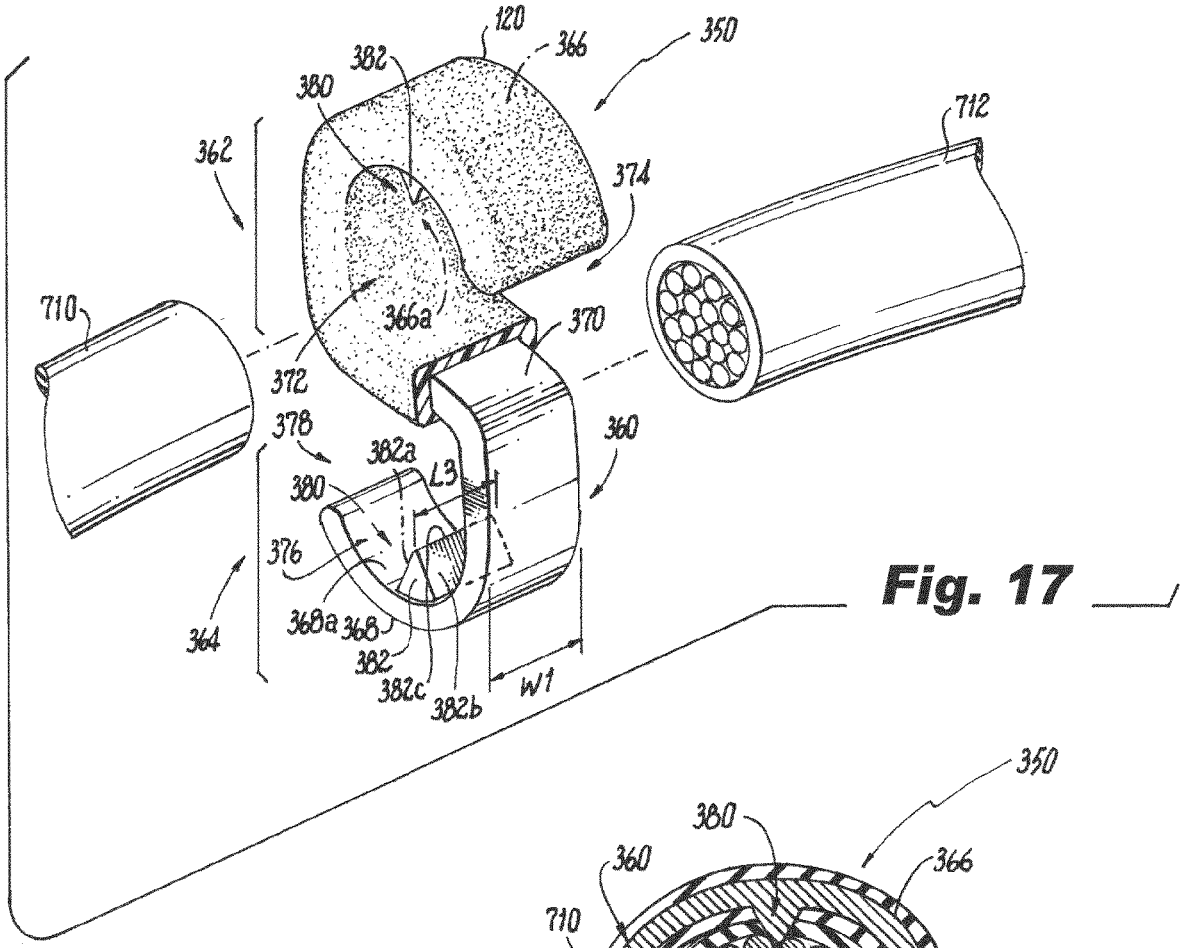
FIG. 17 is a perspective view of another exemplary embodiment of a compression connector according to the present disclosure, illustrating an S-shaped connector body with a portion of the flexible insulating coating removed, with openings for receiving conductors, and with insulation piercing members integrally formed into the body and extending into the openings.
Figure 18:
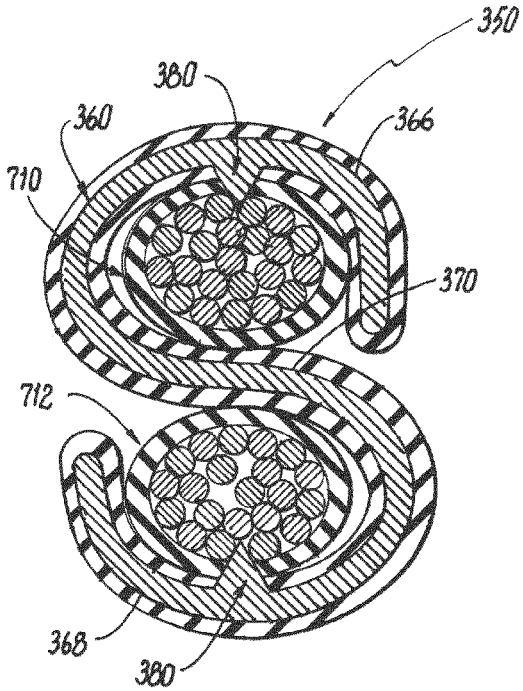
FIG. 18 is a midpoint cross-sectional view of the compression connector of FIG. 17 taken from line 18-18, illustrating conductors positioned within the connector body openings and the compression connector having been subjected to a crimping operation to electrically and compressively connect the conductors.

Referring now to FIGS. 17 and 18, another exemplary embodiment of a connector according to the present disclosure is shown. In this exemplary embodiment, the connector 350 includes a body 360 having a run conductor portion 362 and a branch conductor portion 364. The body 360 is an S-shaped like member having a first wall 366, a second wall 368 and a third wall 370 joining the first wall to the second wall. As such, the first wall 366 and a portion of the third wall 370 form the run conductor portion 362, and the second wall 368 and a portion of the third wall 370 form the branch conductor portion 364. The first, second and third walls 366, 368 and 370 may be a unitary or monolithic structure, or the walls 366, 368 and 370 may be separate walls joined together by, for example, welds. The body 360 includes a run opening 372 and a first lead-in 374 between the first wall 366 and a portion of the third wall 370. The first lead-in 374 is configured and dimensioned to permit a run conductor 710 pass into and be received within the run opening 372. The body 360 also includes a branch opening 376 and a second lead-in 378 between the second wall 368 and a portion of the third wall 370. The second lead-in 378 is configured and dimensioned to permit a branch conductor 712 pass into and be within the branch opening 376.

The first wall 366, in this exemplary embodiment, is a U-shaped like structure configured such that when a run conductor 710 is passed into the opening 372 via lead-in 374, the connector 350 can rest on the run conductor 710 prior to a crimping operation. The second wall 368, in this exemplary embodiment, is a U-shaped like structure configured to receive at least partially a branch conductor 712 passed into the opening 376 via lead-in 378, as seen in FIG. 17. This permits a technician to set-up and operate a crimping tool without having to hold the connector 350 as well.

The connector 350 may also include one or more insulation piercing members 380 extending from an inner surface of the one or more walls 366, 368 and/or 370 of the body 360. In the embodiment shown, a single insulation piercing member 380 extends from an inner surface 366*a* of the first wall 366 into the first opening 372, and a single insulation piercing member 380 extends from an inner surface 368*a* of the second wall 368 into the second opening 376. Each insulation piercing member 380 may be integrally or monolithically formed into one or more walls 366, 368 and/or 370 and extend into the first opening 372 and/or the second opening 376. Each insulation piercing member 380 includes a tip member 382 that is configured and dimensioned to pierce or cut through insulation surrounding a run conductor 710 or the branch conductor 712 when the connector 350 is crimped such that the electrical wires within the conductors 710 and 712 contact the respective insulation piercing member 380 to create an electrical path between the connector 350, the run conductor 710 and the branch conductor 712. Each tip member 382 is, in this exemplary embodiment, a triangular shaped member extending from the respective wall 366 or 368 of the body 360 into the respective opening 372 or 376. More specifically, each tip member 382 includes two side walls 382*a* and 382*b* extending away from the wall of the body 360 and are joined to form a piercing tip 382*c*. The piercing tip 382*c* is configured and dimensioned to pierce or cut through the insulation jacket surrounding the electrical wire in a run conductor 710 or a branch conductor 712 when the connector 350 is crimped, and to contact the electrical wire within the run conductor 710 or the branch conductor 712 to create the electrical path between the connector 350 and the conductors 710 and 712, similar to the connection shown in FIG. 18.

Each tip member 382 has a length "L3" that is less that the width "W1" of the body 360. The length "L3" of the tip member 382 should be sufficiently less than the width "W1" of the body 360 so that the insulation jacket 120 applied to the body 360 surrounds the junction between the walls 366 and 368 and the insulation piercing members 380. By having the length "L3" of the tip members 382 less than the width of the body 360, a seal can form between the connector 350 and a run conductor 710 or a branch conductor 712 when the conductor is crimped to the connector 350. This seal minimizes and possibly prevents water and/or gas from contacting each insulation piercing member 380. As a non-limiting example, if the width "W1" of the body 360 is about 1 inch, the length "L3" of the tip member 382 would preferably be about ½ inch and the tip member 382 would be centered along the width "W1" of the body 360 as shown in FIG. 21. As such, in this exemplary embodiment, the length "L3" of the tip member 382 is about ½ the width "W1" of the body 360. In this exemplary embodiment, the body 360 is typically formed by an extrusion process, metal casting process or a machining process where the insulation piercing members 380 are formed as part of the extrusion process, metal casting process or the insulation piercing member is machined as part of the body 360. In order to harden the insulation piercing members 380, the insulation piercing members can be put through a conventional hardening process, such as heating and then rapidly cooling the insulation piercing member.

Although the insulation piercing members 380 are described above as a triangular shaped member, the insulation piercing members 380 may come in different shapes and sizes configured and dimensioned to pierce or cut through insulation surrounding electrical wires, such as a cone-shaped member or a member with a pointed tip. Further, the insulation piercing members 380 may include a serrated tip to assist in the piercing through insulation surrounding the electrical wires.

It is noted that in the exemplary embodiment shown in FIGS. 17 and 18, the first conductor portion 362 and the second conductor portion 364 are configured and dimensioned with inner surfaces 366*a* and 368*a* shaped to receive conductors, e.g., a run conductor 710 or a branch conductor 712. The configuration of the first opening 372 and the first lead-in 374 and the configuration of the second opening 376 and the second lead-in 378 can vary depending upon the size of the conductor to be crimped. As a non-limiting example, the conductor can range from about 250 Kcmil to about 750 Kcmil.

Figure 20:
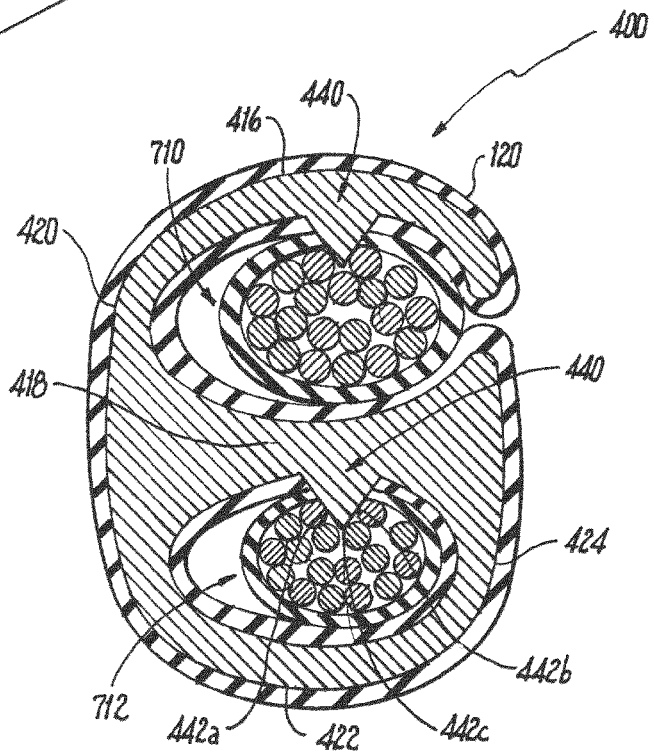
FIG. 20 is a cross-sectional view of the compression connector of FIG. 19, illustrating conductors positioned within the connector body openings and the compression connector having been subjected to a crimping operation to electrically and compressively connect the conductors.

Referring now to FIGS. 19 and 20, another exemplary embodiment of the connector of the present disclosure is shown. In this exemplary embodiment, the connector 400 includes a body 410 having a run conductor portion 412 and a branch conductor portion 414. The run conductor portion 412 of the body 410 is a C-shaped like member having a first wall 416, a common wall 418 and a third wall 420 joining the first wall 416 to the common wall 418. The branch conductor portion 414 of the body 410 is a circular, oval or other shaped member having a second wall 422, the common wall 418, a side walls 424 and 426 joining the second wall 422 to the common wall 418. The walls 416, 418, 420, 422, 424 and 426 may be a unitary or monolithic structure, or the walls 416, 418, 420, 422, 424 and 426 may be separate walls joined together by, for example, welds. The run conductor portion 412 of the body 410 also includes a first opening 428 and a first lead-in 430 between the first wall 416 and a portion of the common wall 418. The lead-in 430 is configured and dimensioned to permit a run conductor 710 to pass through the lead-in 430 into the opening 428. The branch conductor portion 414 of the body 410 also includes a second opening 432 between the second wall 422 and a portion of the common wall 418.

The first wall 416, in this exemplary embodiment, is a U-shaped like structure configured such that when a run conductor 710 is passed into the opening 428 via the lead-in 430, the connector 400 can rest on the run conductor 710 prior to a crimping operation, as seen in FIG. 19.

Continuing to refer to FIGS. 19 and 20, the run conductor portion 412 of the body 410 may also include one or more insulation piercing members 440 extending from an inner surface of the one or more walls 416, 418 and/or 420 toward the first opening 428. Each insulation piercing member 440 may be integrally or monolithically formed into the one or more walls 416, 418 and/or 420, or each insulation piercing member may be a separate structure secured to the one or more walls 416, 418 and/or 420 using, for example, a friction fit or welds. In the embodiment shown, a single insulation piercing member 440 extends from an inner surface 416*a* of the first wall 416 into the first opening 428. The branch conductor portion 412 of the body 410 may also include one or more insulation piercing members 440 extending from an inner surface of the one or more walls 418, 420 and/or 422 toward the second opening 432. Each insulation piercing member 440 may be integrally or monolithically formed into the one or more walls 418, 420 and/or 422, or each insulation piercing member may be a separate structure secured to the one or more walls 418, 420 and/or 422 using, for example, a friction fit or welds. In the embodiment shown, a single insulation piercing member 440 extends from an inner surface 418*a* of the common wall 418 into the second opening 432.

Each insulation piercing member 440 includes a tip member 442 that is configured and dimensioned to pierce or cut through insulation surrounding a run conductor 710 or the branch conductor 712 when the connector 400 is crimped such that the electrical wires within the conductors 710 and 712 contact the respective insulation piercing member 440 to create an electrical path between the connector 400, the run conductor 710 and the branch conductor 712. Each tip member 442 is, in this exemplary embodiment, a triangular shaped member extending from the respective wall 416 or 418 of the body 410 into the respective opening 428 or 432. More specifically, each tip member 442 includes two side walls 442*a* and 442*b* extending away from the wall of the body 410 and are joined to form a piercing tip 442*c*. The piercing tip 442*c* is configured and dimensioned to pierce or cut through the insulation jacket surrounding the electrical wire in a run conductor 710 or a branch conductor 712 when the connector 400 is crimped, and to contact the electrical wire within the run conductor 710 or the branch conductor 712 to create the electrical path between the connector 400 and the conductors 710 and 712, similar to the connection shown in FIG. 20.

Each tip member 442 has a length "L3" that is less that the width "W1" of the body 360. The length "L3" of the tip member 442 should be sufficiently less than the width "W1" of the body 410 so that the insulation jacket 120 applied to the body 410 surrounds the junction between the walls 416 and 418 and the insulation piercing members 440. By having the length "L3" of the tip members 442 less than the width of the body 410, a seal can form between the connector 400 and a run conductor 710 or a branch conductor 712 when the conductor is crimped to the connector 400. This seal minimizes and possibly prevents water and/or gas from contacting each insulation piercing member 440. As a non-limiting example, if the width "W1" of the body 410 is about 1 inch, the length "L3" of the tip member 442 would preferably be about ½ inch and the tip member 442 would be centered along the width "W1" of the body 410 as shown in FIG. 19. As such, in this exemplary embodiment, the length "L3" of the tip member 442 is about ½ the width "W1" of the body 410. In this exemplary embodiment, the body 410 is typically formed by an extrusion process, metal casting process or a machining process where the insulation piercing members 440 are formed as part of the extrusion process, metal casting process or the insulation piercing member is machined as part of the body 410. In order to harden the insulation piercing members 440, the insulation piercing members can be put through a conventional hardening process, such as heating and then rapidly cooling the insulation piercing member.

Although the insulation piercing members 440 are described above as a triangular shaped member, the insulation piercing members 440 may come in different shapes and sizes configured and dimensioned to pierce or cut through insulation surrounding electrical wires, such as a cone-shaped member or a member with a pointed tip. Further, the insulation piercing members 440 may include a serrated tip to assist in the piercing through insulation surrounding the electrical wires.

It is noted that in the exemplary embodiment shown in FIGS. 19 and 20, the first conductor portion 412 and the second conductor portion 414 are configured and dimensioned with inner surfaces shaped to receive conductors, e.g., a run conductor 710 or a branch conductor 712. The configuration of the first opening 428 and the first lead-in 430 and the configuration of the second opening 432 can vary depending upon the size of the conductor to be crimped. As a non-limiting example, the conductor can range from about 250 Kcmil to about 750 Kcmil.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. An electrical compression connector for connecting a plurality of conductors, the compression connector comprising:

a connector body made of compressible material and adapted to be inserted into a crimping tool, the connector body having a first face and a second face defining a width of the connector body, the connector body having a run connector portion and a branch connector portion;

the run connector portion includes a pair of side walls joined by a bottom wall, a run conductor opening extending from the first face to the second face of the connector body between the pair of side walls and the bottom wall, and at least one insulation piercing member having a base and a tip member, the base extending in a direction along the width of the connector body, wherein at least the bottom wall includes at least one channel extending in a direction of the width of the connector body, and wherein the base of the at least one insulation piercing member is received in the at least one channel and the tip member extends into the run conductor opening;

the branch connector portion includes at least one branch conductor opening extending from the first face to the second face of the connector body, the branch conductor opening having a hinge portion between the branch conductor opening and the branch connector portion; and an insulation coating surrounding exposed surfaces of the pair of side walls and bottom wall of the run connector portion and surrounding exposed surfaces of the branch connector portion such that an interior wall of the at least one branch conductor opening and at least the tip member of the at least one insulation piercing member are not covered by the insulation coating.

2. The compression connector according to claim 1, wherein the base of the at least one insulation piercing member is removably received in the at least one channel.

3. The compression connector according to claim 1, wherein the at least one branch conductor opening includes a plurality of branch conductor openings each having a hinge portion between the branch conductor opening and the branch connector portion.

4. The compression connector according to claim 1, wherein a length of the at least one channel is the same as the width of the connector body.

5. The compression connector according to claim 1, wherein the base of the at least one insulation piercing member has a length that is about the same as the width of the connector body, and the tip member has a length that is less than or equal to the length of the base.

6. The compression connector according to claim 1, wherein the base of the at least one insulation piercing member has a length that is less than the width of the connector body, and the tip member has a length that is less than or equal to the length of the base.

* * * * *